US009653240B2

(12) United States Patent
Namikawa et al.

(10) Patent No.: US 9,653,240 B2
(45) Date of Patent: May 16, 2017

(54) CIRCUIT BREAKER AND SAFETY CIRCUIT AND SECONDARY BATTERY CIRCUIT INCLUDING THE SAME

(71) Applicant: KOMATSULITE MFG. CO., LTD., Suita-shi, Osaka (JP)

(72) Inventors: Masashi Namikawa, Suita (JP); Takuya Sunada, Suita (JP)

(73) Assignee: KOMATSULITE MFG. CO., LTD., Suita-shi, Osaka (JP)

( * ) Notice: Subject to any disclaimer, the term of this patent is extended or adjusted under 35 U.S.C. 154(b) by 0 days.

(21) Appl. No.: 14/812,808

(22) Filed: Jul. 29, 2015

(65) Prior Publication Data

US 2016/0035521 A1 Feb. 4, 2016

(30) Foreign Application Priority Data

Jul. 30, 2014 (JP) ..... 2014-155326

(51) Int. Cl.
*H01H 37/04* (2006.01)
*H01H 37/52* (2006.01)
*H01H 37/54* (2006.01)

(52) U.S. Cl.
CPC ..... *H01H 37/04* (2013.01); *H01H 37/5427* (2013.01)

(58) Field of Classification Search
CPC .. H01H 37/04; H01H 37/52; H01H 2205/002; H01H 2223/002; H01H 37/5427
USPC ..... 337/380
See application file for complete search history.

(56) References Cited

U.S. PATENT DOCUMENTS

| | | | | |
|---|---|---|---|---|
| 4,862,133 | A * | 8/1989 | Tabei | H01H 1/504 337/102 |
| 5,607,610 | A * | 3/1997 | Furukawa | H01H 1/504 219/488 |
| 6,396,381 | B1 * | 5/2002 | Takeda | H01H 1/504 337/342 |
| 7,330,097 | B2 * | 2/2008 | Takeda | H01H 1/504 337/102 |
| 2002/0060898 | A1 * | 5/2002 | Nagai | H01H 37/54 361/634 |

(Continued)

FOREIGN PATENT DOCUMENTS

| | | |
|---|---|---|
| EP | 2 541 576 A1 | 1/2013 |
| WO | WO 2011/105175 A1 | 9/2011 |

*Primary Examiner* — Anatoly Vortman
(74) *Attorney, Agent, or Firm* — Birch, Stewart, Kolasch & Birch, LLP

(57) ABSTRACT

A circuit breaker 1 comprises: a fixed-contact piece 2 with a fixed contact 21; a movable-contact piece 4 with a movable contact 41; a thermal actuator element 5 thermally transformable to move the movable-contact piece; a PTC thermistor 6 for conducting electricity between the movable-contact piece 4 and the fixed-contact piece 2; a main body 71 of a package provided with a holding recess 73 housing the above-mentioned components; and a cover 81 hermetically covering the holding recess 73. The fixed-contact piece 2 is embedded between an internal wall 74 and an external wall 75 of the main body 71. The PTC thermistor 6 is housed in an opened hollow 73*d*. In a planar view of the circuit breaker, a through-hole 76 penetrating through the external wall 75 overlaps with the opened hollow 73*d*, but does not overlap with the centroid O of the opened hollow 73*d*.

12 Claims, 9 Drawing Sheets

(56) References Cited

U.S. PATENT DOCUMENTS

| | | | | |
|---|---|---|---|---|
| 2005/0174211 | A1* | 8/2005 | Takeda | H01H 1/504<br>337/377 |
| 2013/0323547 | A1* | 12/2013 | Namikawa | H01H 61/01<br>429/61 |
| 2014/0285308 | A1* | 9/2014 | Namikawa | H01H 37/04<br>337/1 |
| 2014/0334055 | A1* | 11/2014 | Namikawa | H01H 37/04<br>361/115 |
| 2016/0035522 | A1* | 2/2016 | Namikawa | H01H 37/52<br>337/362 |

* cited by examiner

CIRCUIT BREAKER AND SAFETY CIRCUIT AND SECONDARY BATTERY CIRCUIT INCLUDING THE SAME

BACKGROUND OF THE INVENTION

Technical Field

The present invention relates to a micromini built-in circuit breaker for use in, for example, secondary battery packs of electric devices and the like.

Background Art

In various electric devices, a circuit breaker is employed as a protective means (safety circuit) for a secondary battery, an electric motor or the like of such electric device. The circuit breaker cuts off the electric current in order to protect the secondary battery, the electric motor or the like if an abnormality has occurred, for example, the temperature of the secondary battery has overly increased during discharging or charging, or an overcurrent has flowed in the electric motor incorporated in a machine such as automobile, home electric appliance and the like, Such circuit breaker used as a protective means is required to operate accurately responding to a temperature change (to have good temperature characteristic) and to show a stable low electric resistance in its conduction state or closed state.

The circuit breaker includes a thermal actuator element for opening or closing the electrical contacts according to the temperature change.

In the international patent application publication No. WO2011/105175 (hereinafter, patent literature 1), a circuit breaker is disclosed, wherein a bimetal is used as the thermal actuator element. The bimetal is, as well known, composed of two layers of metals which has different coefficients of thermal expansion and which are joined together. According to a temperature change, the bimetal changes its shape, and the thermal actuator element using such bimetal can control the opened or closed state of the electrical contacts of the circuit breaker.

Components of the circuit breaker such as the thermal actuator element, a PTC thermistor, a movable-contact piece, and a fixed-contact piece are housed in a package.

In order to use the circuit breaker, a terminal of the fixed-contact piece and a terminal of the movable-contact piece are connected to an electric circuit of an electric device.

In the circuit breaker disclosed in the patent literature 1, the fixed-contact piece is integrated with a main body of the package (resinous base) through an insert molding technique. (cf. paragraph [0031] of patent literature 1)

SUMMARY OF THE INVENTION

Technical Problem

In the patent literature 1, the main body and a cover which constitutes the mold package are each made of a resinous material, and they are joined using ultrasonic welding to achieve high joint strength and airtightness (sealing effect).

Meanwhile, the fixed-contact piece, which constitutes a part of the electric circuit together with the movable-contact piece, is made of a metallic material containing copper in major proportions.

The joint strength between such metallic material and the resinous material becomes lower than the joint strength between the resinous materials, therefore, it is difficult to obtain strong adhesion between the fixed-contact piece and the package's main body.

If the circuit breaker is used in very high temperature, high humidity environments over a long period of time, there is a possibility that the moisture vapor as well as gaseous matters occurring in the ambient environment surrounding the circuit breaker penetrate into the internal space of the package in which the thermal actuator element and the like are housed. Thus, there is concern that the moisture vapor and the like penetrating into the internal space of the circuit breaker adversely affect the metallic materials constituting the thermal actuator element and the like.

In recent years, on the other hand, there is a demand for a production method such that a circuit breaker is mounted on a circuit board, and then the terminals of the circuit breaker are connected to conductive traces or lands of the circuit board through a reflow soldering technique in order to improve the productive efficiency.

In such a production method, however, there is a possibility that the soldering flux penetrates into the circuit breaker through a gap occasionally occurred between the fixed-contact piece and the package's main body.

In the circuit breaker disclosed in the patent literature 1, a part of the under surface of the fixed-contact piece (including a tip end portion thereof) is exposed to the outside of the package. That is, the joint in the tip end portion of the fixed-contact piece is that between the metallic material and resinous material, therefore, there is a possibility that the airtightness is affected.

Therefore, in order to increase the airtightness, it is conceivable that the under surface of the fixed-contact piece is covered with resin, for example.

In FIG. 10, a circuit breaker 101 is shown, wherein the under surface of a fixed-contact piece 102 is covered with an external wall 174 of a main body 171 of the package.

In this case, a mold, which is used for molding the main body 171 of the package by inserting the fixed-contact piece 102, has to be provided with a cavity which extends over the under surface of the fixed-contact piece 102 to be filled with the resin 171*b* to cover the under surface.

Further, the internal wall 174 of the main body 171 of the package is provided with an opened hollow 173*d* in which a PTC thermistor 106 is housed in a conductive state such that the PTC thermistor 106 makes electrically good contact with the fixed-contact piece 102.

Due to the presence of the above-mentioned cavity to be filled with the resin 171*b* to cover the under surface, the above-mentioned mold can not support the under surface of the inserted fixed-contact piece 102. Therefore, during injecting the resin into the mold, the fixed-contact piece 102 is liable to be deformed, for example, in its tip end portion 125 as shown in FIG. 11 by the pressure of the injected resin.

If the fixed-contact piece 102 is deformed, the resin 171*z* penetrating along the surface of the deformed part of the fixed-contact piece 102 is hardened to set the deformed state of the fixed-contact piece 102.

FIG. 11 shows the circuit breaker 101 shown in FIG. 10 under such a state that, by overheating, the thermal actuator element 105 is transformed. In FIG. 11, the shape of the above-mentioned deformed fixed-contact piece 102 is indicated by solid line, and the proper shape of the fixed-contact piece 102 is indicated by chain double-dashed line.

In this circuit breaker 101, the PTC thermistor 106 is disposed on the fixed-contact piece 102. Therefore, if the tip end portion 125 of the fixed-contact piece 102 is deformed as indicated by solid line, then the position or posture of the PTC thermistor 106 relatively to the main body 171 of the package is displaced from its proper position or posture.

Such displacement of the PTC thermistor 106 relative to the main body 171 of the package affects the position or posture of the thermal actuator element 105 when thermally transformed or when operating. Consequently, the pushing-up height for the movable-contact piece 104, namely, the distance of the movable contact 141 from the fixed contact 121 when opened becomes small, and there is a possibility of affecting the current cutoff action of the circuit breaker 101, for example, as shown in FIG. 11 wherein, although the thermal actuator element 105 has been thermally transformed, the fixed contact 121 still contacts with the movable contact 141 due to the deformation of the tip end portion 125 of the fixed-contact piece 102.

In the example shown in FIG. 11, the tip end portion 125 has been deformed downwardly. If the tip end portion 125 is deformed upwardly, there is a possibility of affecting the contact resistance between the fixed contact 121 and the movable contact 141 in normal operation.

The present invention was made in order to solve the above-mentioned problems, and aims at providing a circuit breaker, in which good current cutoff action can be obtained by optimizing positions or postures of a PTC thermistor, a thermal actuator element and the like while improving airtightness and joint strength between a fixed-contact piece and a main body of the package.

Solution to Problem

In order to achieve the above-mentioned object, a circuit breaker according to the present invention which has a fixed-contact piece with a fixed contact, a movable-contact piece with a movable contact for pushing the movable contact onto the fixed contact to make contact therewith, a thermal actuator element transforming along with its temperature change to move the movable-contact piece so that the movable contact and the fixed contact are opened, a positive temperature coefficient (PTC) thermistor for conducting electricity between the movable-contact piece and the fixed-contact piece through the thermal actuator element when the movable contact and the fixed contact are opened, a main body of a package provided with a holding recess holding the fixed-contact piece, the movable-contact piece, the thermal actuator element and the PTC thermistor, and a cover hermetically covering the holding recess, is characterized in that the fixed-contact piece is embedded between an internal wall and an external wall of the package's main body, the internal wall of the package's main body is provided with an opened hollow which penetrates through the internal wall and which houses the PTC thermistor in a conductive state capable of conducting electricity between the PCT thermistor and the fixed-contact piece, and the external wall of the package's main body is provided with a through-hole which penetrates through the external wall so that, in a plan view, at least part of the through-hole is overlapped with at least part of the opened hollow, and the through-hole is not overlapped with the centroid of the opened hollow.

In the circuit breaker of the present invention, it is preferable that the fixed-contact piece has a tip end portion embedded in the package's main body between the internal wall and the external wall, and the through-hole is disposed on the tip end portion side of the centroid of the opened hollow.

In the circuit breaker of the present invention, it is preferable that the package's main body is formed by a resin injected through a gate of a die, and the through-hole is disposed on the gate side of the centroid of the opened hollow.

In the circuit breaker of the present invention, it is preferable that the through-hole is provided at each of multiple positions.

A safety circuit for an electric device according to the present invention is characterized by including the circuit breaker.

A secondary battery circuit according to the present invention is characterized by including the circuit breaker.

Advantageous Effects of Invention

In the circuit breaker according to the present invention, since the fixed-contact piece is embedded between the internal wall and the external wall of the package's main body, airtightness and joint strength between the fixed-contact piece and the package's main body are improved.

Since the internal wall of the package's main body has the opened hollow penetrating through the internal wall, the PTC thermistor can be housed in the opened hollow in a conductive state capable of conducting electricity between the PCT thermistor and the fixed-contact piece.

The external wall of the package's main body has the through-hole penetrating through the external wall. Such main body of the package can be formed by inserting the fixed-contact piece in a mold and injecting a resinous material, for example.

In a plan view of the circuit breaker, the through-hole overlaps with at least part of the opened hollow, therefore, a protrusion for forming the opened hollow and a protrusion for forming the through-hole provided in the cavity of the mold used for injection moulding, are at least partially opposed to each other. The mutually opposed protrusions can support the fixed-contact piece from both sides thereof. This prevents the fixed-contact piece from being deformed when injecting the resinous material. Accordingly, the PTC thermistor, the thermal actuator element and the like keep their proper positions or postures, and the circuit breaker can provide good current cutoff performance.

Since the through-hole is not overlapped with the centroid of the opened hollow, the fixed-contact piece can be firmly supported by the above-mentioned protrusions near the peripheral edge of the opened hollow. Thereby, the resinous material forming the package's main body is prevented from flowing over the fixed-contact piece into the opened hollow from the peripheral edge thereof, and the fixed-contact piece can be further prevented from being deformed.

DESCRIPTION OF THE PREFERRED EMBODIMENTS

Figure 1:
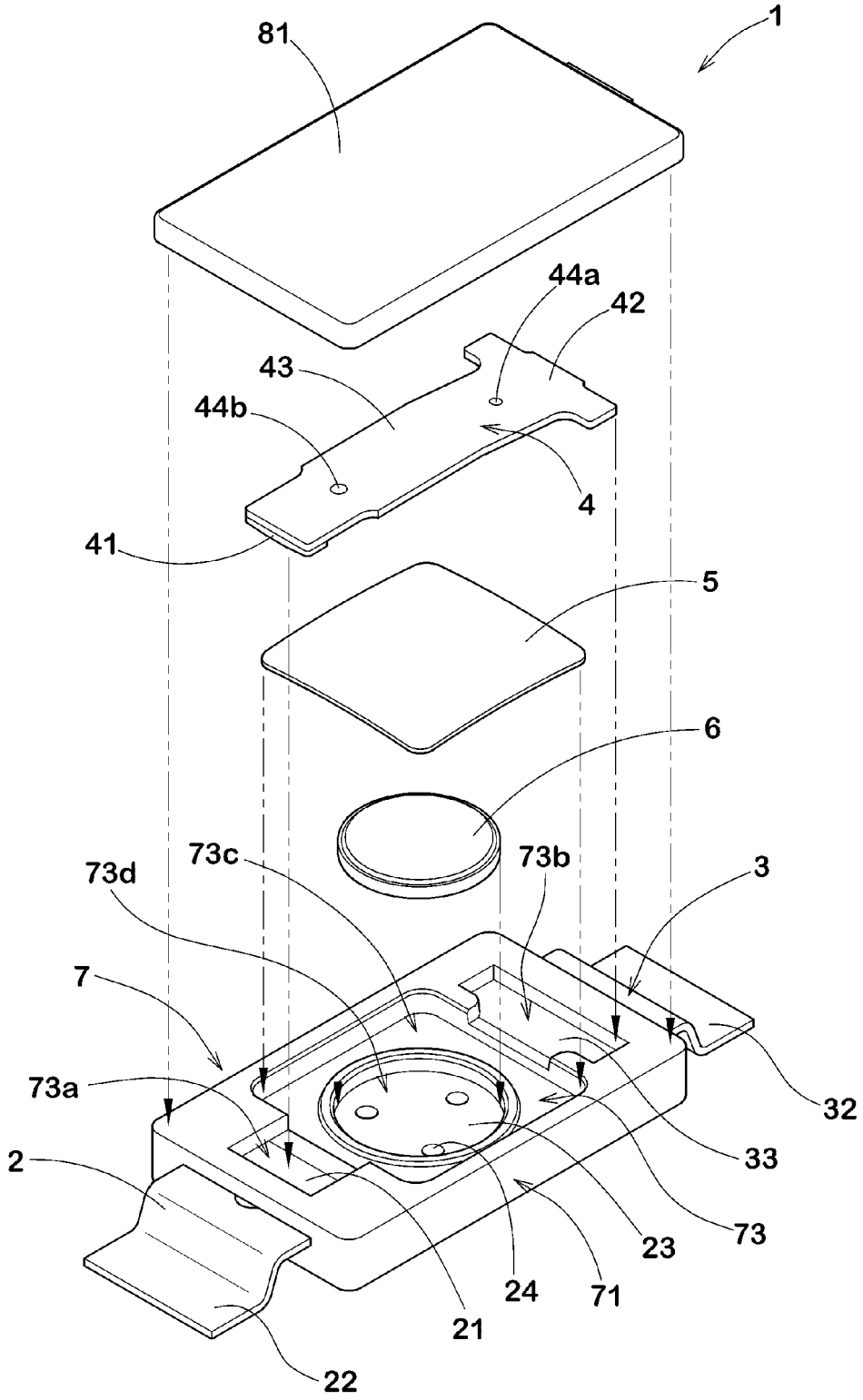
FIG. 1 is an exploded perspective view schematically showing a circuit breaker as an embodiment of the present invention.

Referring to the accompanying drawings, embodiments of the present invention will now be described in detail.

In this application, in order to simplify the description, based on the attitude or orientation of the circuit breaker shown in the drawings, the terms "up" and "down", "upper" and "under", "above" and "below", etc. are used to describe positional relationships of various parts, portions, positions, directions and the like. But, such description should not be construed as to limit the attitude of the circuit breaker in use. The circuit breaker can be used in every orientation.

Figure 2:
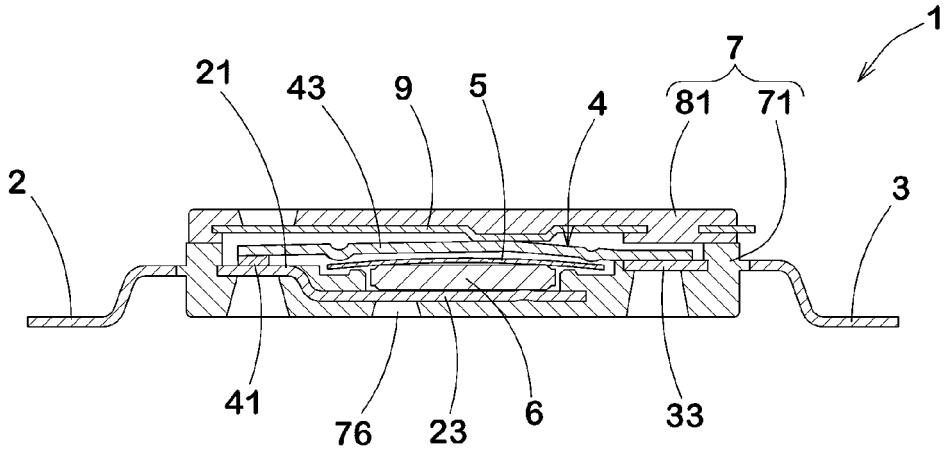
FIG. 2 is a cross sectional view of the circuit breaker showing its closed state or normal state.
Figure 3:
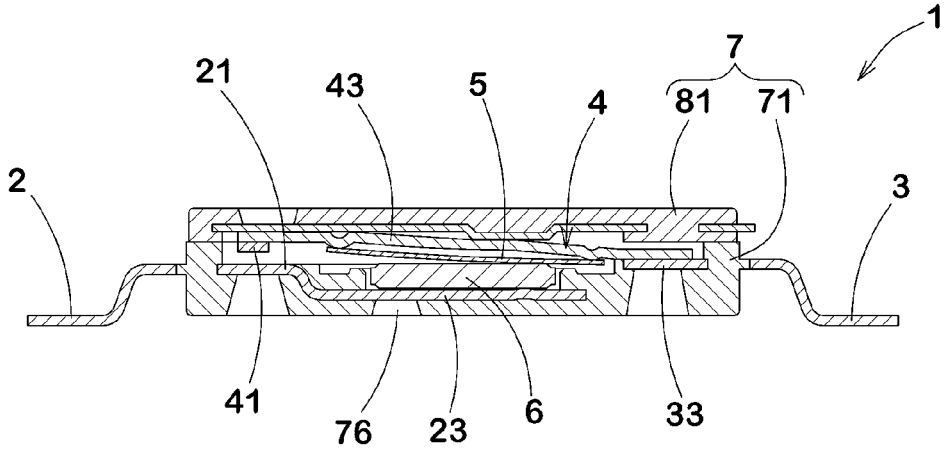
FIG. 3 is a cross sectional view of the circuit breaker showing its opened state or abnormal state.

In FIGS. 1-3 showing a structure of a circuit breaker as an embodiments of the present invention, the circuit breaker 1 comprises:

a fixed-contact piece 2 provided on its upper surface with a fixed contact 21, a terminal piece 3 provided with a terminal 32, a movable-contact piece 4 provided with a movable contact 41 on its under surface of a tip end portion thereof, a thermal actuator element 5 which is transformable along with its temperature change, a positive temperature coefficient (PTC) thermistor 6, and a package 7 housing the fixed-contact piece 2, the terminal piece 3, the movable-contact piece 4, the thermal actuator element 5 and the PTC thermistor 6.

The package 7 comprises a main body 71 (first part) and a cover 8 (second part) attached to the upper surface of the package's main body 71.

In this embodiment, the shape of the package 7 is substantially a rectangular parallelepiped having a thickness of about 1 mm, a width of about 3 mm and a length of about 5 mm.

The fixed-contact piece 2 is embedded in the package's main body 71 through an insert moulding technique.

The fixed-contact piece 2 is formed from a metal sheet by press working.

For the metal sheet, copper alloys containing copper in major proportions, for example, copper-titanium alloy, nickel silver, brass and the like can be preferably used.

The fixed-contact piece 2 is provided in its outer end portion (outside the package) with a terminal 22 to be electrically connected to an external circuit.

The terminal 22 protrudes outwardly of the package's main body 71 from an end of the package's main body 71.

The fixed-contact piece 2 is further provided in its inner portion (inside the package) with a support section 23 for supporting the PTC thermistor 6.

The support section 23 is provided on the upper surface thereof with three protrusions (dowels) 24.

The support section 23 is exposed through an opened hollow 73*d* formed in the upper surface of the package's main body 71. The PTC thermistor 6 is placed on the protrusions (dowels) 24 and supported by the protrusions 24.

The fixed contact 21 is formed by cladding, plating or applying a metal material having superior electrical conductivity, for example, silver, nickel, nickel-silver alloy, copper-silver alloy, gold-silver alloy and the like.

The fixed contact 21 is placed at a position opposed to the movable contact 41, and exposed through an opened hollow 73*a* formed in the upper surface of the package's main body 71.

The terminal piece 3 is formed from a sheet of metal containing copper in major proportions by press working similarly to the fixed-contact piece 2.

The terminal piece 3 is embedded in the package's main body 71 through an insert moulding technique.

The terminal piece 3 is provided in its one end portion with the terminal 32. The terminal 32 protrudes outwardly of the package's main body 71 from an end of the package's main body 71 to be electrically connected to an external circuit.

The terminal piece 3 is further provided in its other end portion (inside the package) with a joint section 33. The joint section 33 is electrically connected to the movable-contact piece 4.

For that purpose, an upper surface of the joint section 33 is exposed through an opened hollow 73*b* which is formed in the upper surface of the package's main body 71.

The movable-contact piece 4 is formed from a sheet of a metal material by press working in the form of an arm which is symmetric about its center line extending in the longitudinal direction thereof.

As to the metal material of the movable-contact piece 4, a metal containing copper in major proportions which is equivalent to that of the fixed-contact piece 2 is preferably used. In addition, an electrically conductive elastic material, for example, copper-titanium alloy, nickel silver, brass and the like may be used.

The movable-contact piece 4 is provide in its one end portion with a joint section 42 electrically connected to the above-mentioned joint section 33 of the terminal piece 3. For example, the joint section 42 can be fixed to the joint section 33 by welding.

The movable-contact piece 4 is provided in its other end portion with the movable contact 41.

The movable contact 41 is made of a material equivalent to that of the fixed contact 21 and joined to the under surface of the other end portion of the movable-contact piece 4 by means of welding, cladding, crimping or the like.

Further, the movable-contact piece 4 is provided between the movable contact 41 and the joint section 42 with a resilient section 43.

The movable-contact piece 4 is fixed in the joint section 42 to the joint section 33 of the terminal piece 3. The resilient section 43 extends from the joint section 42 to the movable contact 41. In the closed state, the movable contact 41 is pressed onto the fixed contact 21 by elasticity deformation of the resilient section 43.

In the resilient section 43, the movable-contact piece 4 is curved or bent through the press working.

The degree of the curvature or bend may be arbitrarily set by considering the elastic forces at the operating temperature and return temperature, the pressing force for the contact and the like. The degree is not limited as far as the thermal actuator element 5 can be housed together.

The resilient section 43 is provided on the under surface thereof with a pair of protrusions (contact points) 44*a* and 44*b* toward the thermal actuator element 5.

The protrusions 44*a* and 44*b* contact with the thermal actuator element 5 in order to introduce the transformation of the thermal actuator element 5 to the resilient section 43 of the movable-contact piece 4. (cf. FIG. 1, FIG. 2 and FIG. 3)

The thermal actuator element 5 is a laminate of thin plates having different coefficients of thermal expansion. The thermal actuator element 5 has an initial shape curved convexly toward one side (upper side as shown in FIG. 2). If the temperature of the thermal actuator element 5 is increased and reached to the operating temperature, the thermal actuator element 5 is warped in a clap and changes its shape from the above-mentioned initial shape to a shape curved reversely or convexly toward the other side (under side as shown in FIG. 3).

If the temperature of the thermal actuator element 5 is decreased below the return temperature, the shape reverts to the initial shape in a clap.

It is possible to give such initial shape to the thermal actuator element 5 by press working.

It is preferable that the shape of the thermal actuator element 5 in its plan view is a rectangle from a point of view of the production efficiency and the occurrence of warping. Further, a rectangle close to a square is preferable in order to effectively push up the resilient section 43 while achieving the miniaturization.

However, the shape as well as the material of the thermal actuator element 5 are not to be limited particularly as far as the thermal actuator element 5 warps at the desired temperature to push up the resilient section 43 of the movable-contact piece 4, and the shape reverts to the initial shape by the elastic force of the resilient section 43.

As to the materials of the thermal actuator element 5, two kinds of materials having different coefficients of thermal expansion are selected from various alloys to meet the required conditions, for example, copper-nickel-manganese alloy or nickel-chrome-iron alloy for the higher coefficient of thermal expansion, and iron-nickel alloy, nickel silver, brass or stainless steel for the lower coefficient of thermal expansion.

The PTC thermistor 6 is disposed between the fixed-contact piece 2 and the thermal actuator element 5.

The fixed-contact piece 2 is disposed beneath the thermal actuator element 5, and the PTC thermistor 6 is sandwiched therebetween.

If the thermal actuator element 5 is warped as explained above, the fixed contact 21 and the movable contact 41 are opened. If opened during the electric current flows between the contacts 21 and 41, an electric current flowing in the PTC thermistor 6 increases from substantially zero.

The type, material, shape and the like of the PTC thermistor 6 can be arbitrary selected according to the required conditions, the operating current, operating voltage, operating temperature, return temperature and the like.

This embodiment uses a PTC thermistor made from a ceramic sintered compact comprising barium titanate, strontium titanate or calcium titanate. Aside from such ceramic sintered compact, an polymeric PTC comprising a polymer matrix loaded with carbon black particles or the like may be used.

The package's main body 71 and the cover 81 constituting the package 7 are each made of a thermoplastic resin, e.g. flame-retardant polyamide, heat-resisting polyphenylene sulfide (PPs), liquid crystal polymer (LCP), polybutylene terephthalate (PBT) and the like. Of course, materials other than those above can be used as far as which have moldability, resistance to high temperatures, insulation quality and rigidity similar to those of the above.

The package's main body 71 is provided with a holding recess 73 for holding therein the movable-contact piece 4, the thermal actuator element 5 and the PTC thermistor 6.

The holding recess 73 includes: the above-mentioned opened hollows 73*a* and 73*b* for holding therein the movable-contact piece 4; the above-mentioned opened hollow 73*d* for holding therein the PTC thermistor 6; and an opened hollow 73*c* for holding therein the movable-contact piece 4 and the thermal actuator element 5.

The shape and size of the holding recess 73 is such that the inner surface of the holding recess 73 comes into contact with the edges of the movable-contact piece 4, the thermal actuator element 5 and the PTC thermistor 6 which are built in the package's main body 71 so as to guide the edges of the moving parts when the thermal actuator element 5 is warped.

The cover 81 is provided with a metallic cover piece 9 embedded therein through an insert moulding technique. The cover piece 9 is formed by press working of a sheet of a metal, for example, the above-mentioned metal containing copper in major proportions, stainless steel and the like.

On the upper surface of the metallic cover piece 9, the above-mentioned resin is disposed to form an outer surface of the cover 81.

On the other hand, as shown in FIG. 2 and FIG. 3, the most part of the under surface of the metallic cover piece 9 is exposed, and timely comes into contact with the movable-contact piece 4 to limit the movement of the movable-contact piece 4.

Further, the metallic cover piece 9 increases the rigidity and strength of the cover 81 and the package 7 and helps to miniaturize the circuit breaker 1.

The cover 81 is, as shown in FIG. 1, assembled with the package's main body 71 so as to close the opened hollows 73*a*, 73*b*, 73*c* and 73*d* of the package's main body 71 in which the fixed-contact piece 2, the terminal piece 3, the movable-contact piece 4, the thermal actuator element 5 and the PTC thermistor 6 are held. For example, through an ultrasonic welding technique, the cover 81 is joined to the package's main body 71.

As shown in FIG. 2, in the normal operating state of the circuit breaker 1 under normal temperature, the thermal actuator element 5 keeps the initial shape, and the fixed contact 21 and the movable contact 41 are closed. Thereby, the circuit breaker 1 is normally conductive between the terminals 22 and 32 through the resilient section 43 of the movable-contact piece 4, etc.

In the normal operating state, as shown in FIG. 2, the resilient section 43 may contact with the thermal actuator element 5. If contact, an electrical path through the movable-contact piece 4, the thermal actuator element 5, the PTC thermistor 6 and the fixed-contact piece 2 is formed. Even so, since the electric resistance of the PTC thermistor 6 is very high when compared with the electric resistance of the movable-contact piece 4, the electric current flowing in the PTC thermistor 6 is negligibly small in comparison with the electric current flowing between the fixed contact 21 and the movable contact 41.

As shown in FIG. 3, in the abnormal operating state of the circuit breaker 1 when the thermal actuator element 5 is subjected to high temperature and the temperature reaches to the operating temperature, the thermal actuator element 5 is warped and pushes up the resilient section 43 of the movable-contact piece 4 to open the movable contact 41 and the fixed contact 21.

Therefore, the electric current flowing between the fixed contact 21 and the movable contact 41 is shut off, but a small leak current flows through the thermal actuator element 5 and the PTC thermistor 6.

As far as the leak current flows, the PTC thermistor 6 generates heat so that the warped state of the thermal actuator element 5 is maintained. Thereby, a self-holding circuit where only the small leak current flows bypassing between the fixed contact 21 and the movable contact 41 is constituted.

Incidentally, such leak current may be utilized for another function of the safety system.

If the voltage between the terminals 22 and 32 is removed or reduced to stop the heat generation from the PTC thermistor 6 and the temperature of the thermal actuator element 5 is decreased to the return temperature, then the thermal actuator element 5 reverts to the initial shape, and the movable contact 41 and the fixed contact 21 are closed by the elastic force of the resilient section 43 of the movable-contact piece 4. Thus, the circuit breaker 1 returns to the conduction state shown in FIG. 2.

Figure 4A:
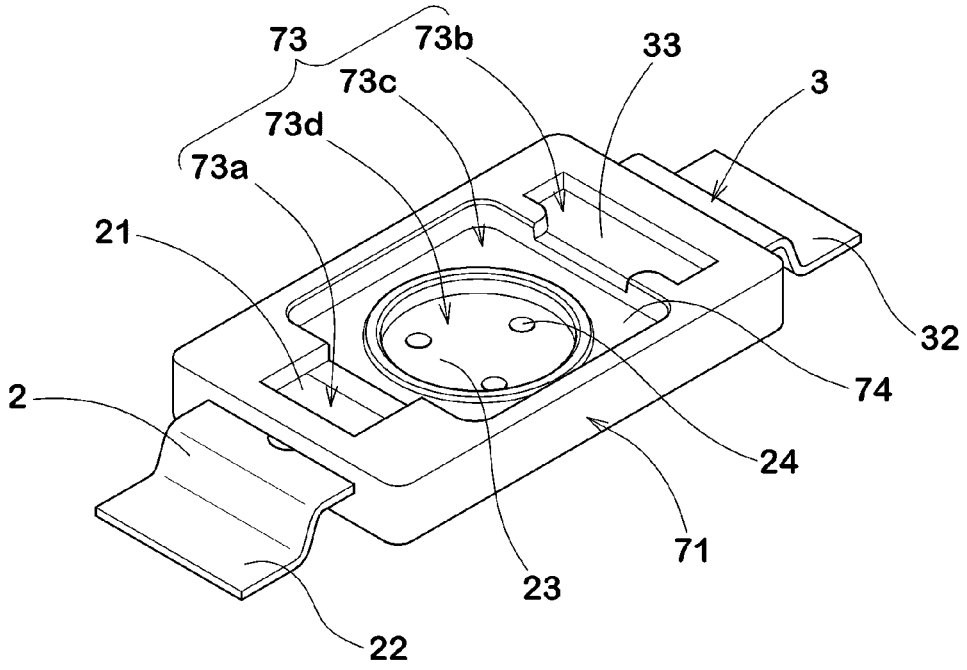
FIG. 4(*a*) and FIG. 4(*b*) are perspective views respectively showing the upper surface and the under surface of a main body of the package of the circuit breaker.
Figure 4B:
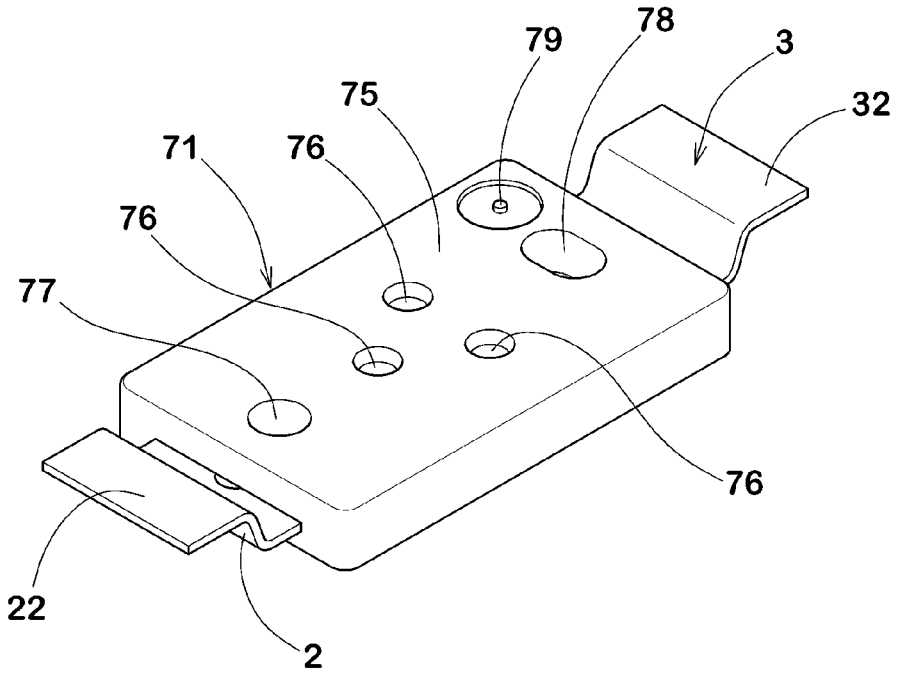
Figure 5A:
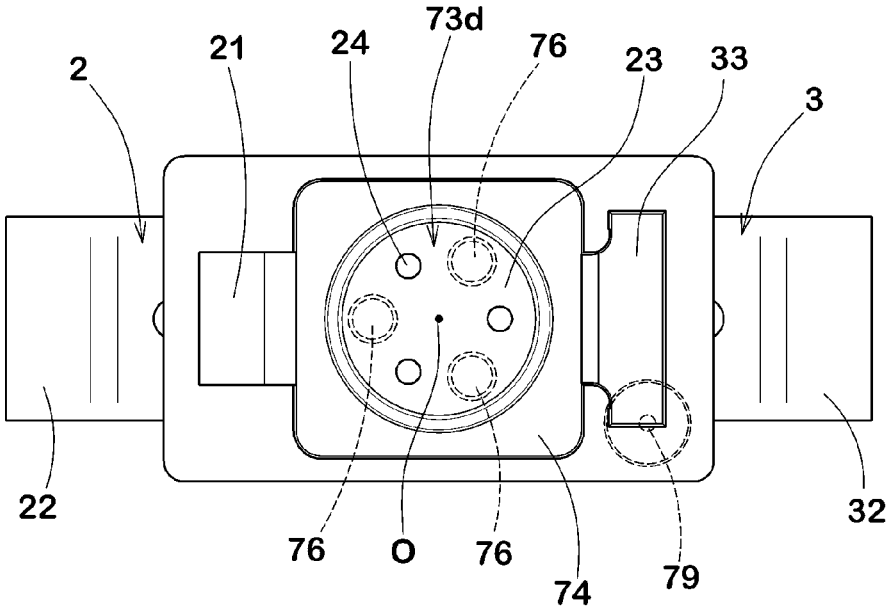
FIG. 5(*a*) and FIG. 5(*b*) are a top view and a bottom view, respectively, of the package's main body.
Figure 5B:
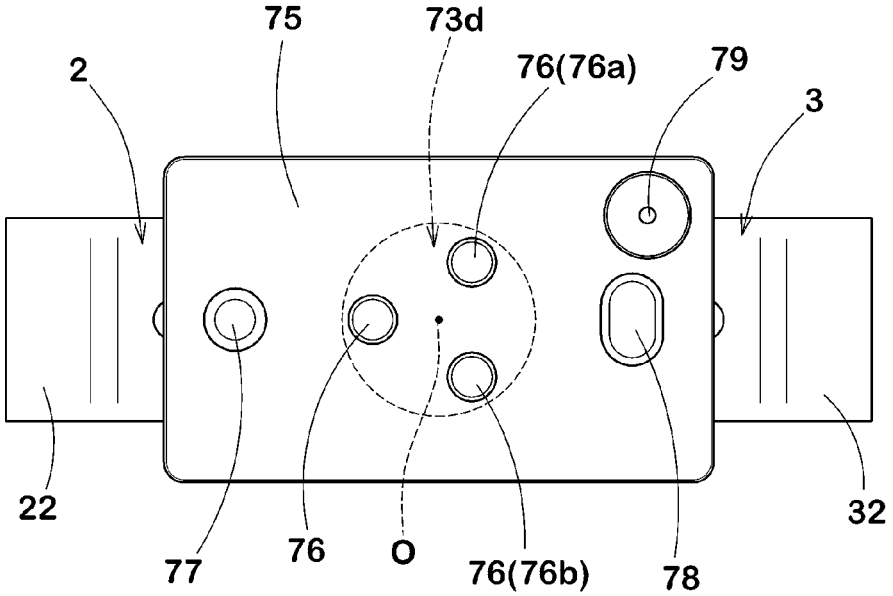

The package's main body 71 in which the fixed-contact piece 2 and the terminal piece 3 are embedded is shown in FIGS. 4(*a*)-4(*b*) and 5(*a*)-5(*b*). FIG. 4(*a*) shows the package's main body 71 viewed obliquely from above. FIG. 4(*b*) shows package's main body 71 viewed obliquely from below. FIG. 5(*a*) shows package's main body 71 viewed from directly above. FIG. 5(*b*) shows package's main body 71 viewed from directly below.

Figure 6:
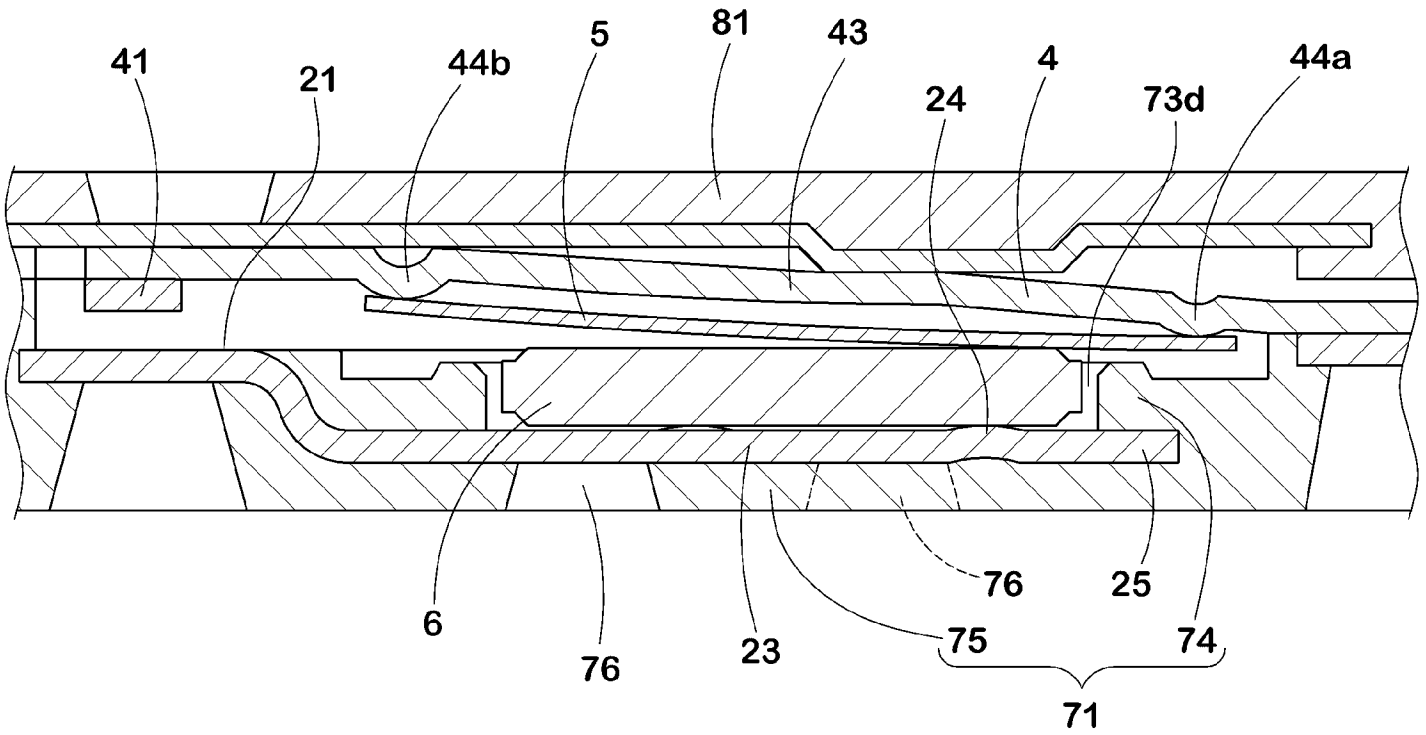
FIG. 6 is a cross sectional view of the package's main body.
Figure 7A:
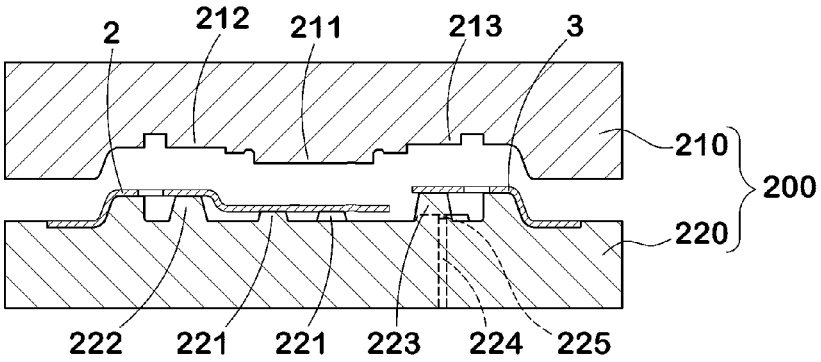
FIGS. 7(*a*)-7(*d*) are cross sectional views for explaining processes for molding the package's main body.
Figure 7B:
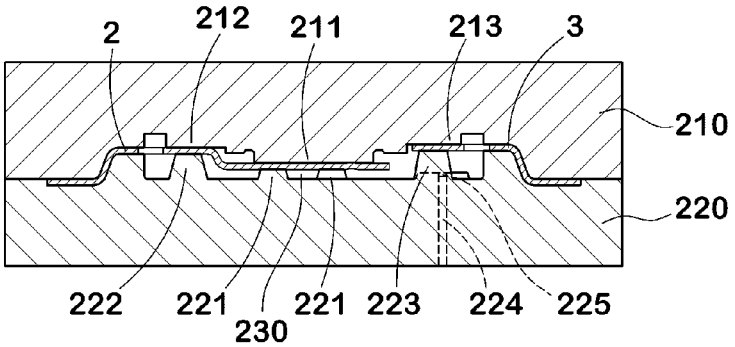
Figure 7C:
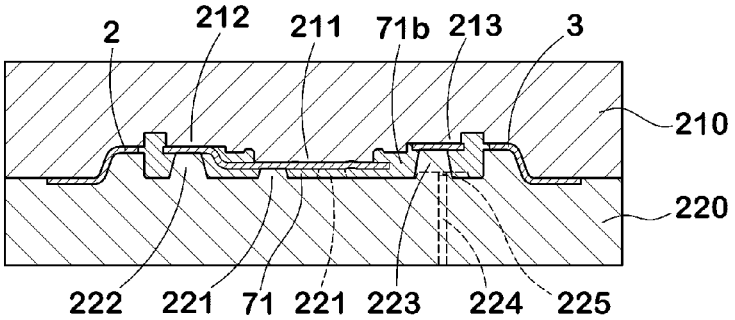
Figure 7D:
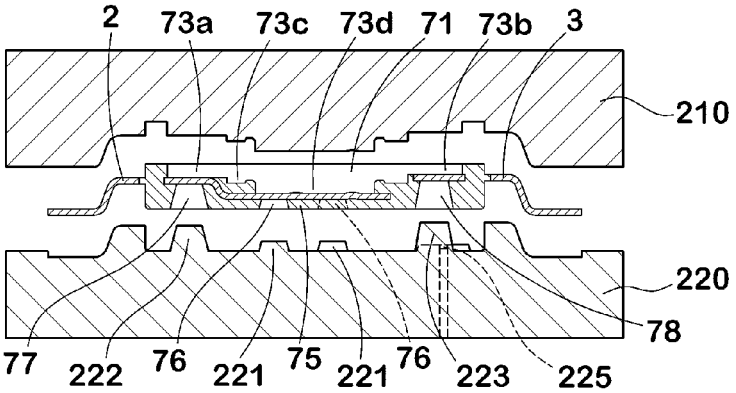

The PTC thermistor 6 held in the package's main body 71 is shown in FIG. 6. This cross sectional view is taken along a center line of circuit breaker which extends, horizontally in FIG. 5(*a*) for example, passing through the centroid O. The thermal actuator element 5 shown in FIG. 6 has been warped by temperature rise.

As shown, the package's main body 71 has an internal wall 74 provided in an inner side of the package 7 and an external wall 75 provided in an outer side of the package 7.

Between the internal wall 74 and the external wall 75, the fixed-contact piece 2 is embedded in order to increase the airtightness and joint strength between the fixed-contact piece 2 and the package's main body 71.

The internal wall 74 is provided with the above-mentioned opened hollow 73*d* for holding therein the PTC thermistor 6. The opened hollow 73*d* penetrates through the internal wall 74, and the upper surface of the support section 23 of the fixed-contact piece 2 is exposed at the bottom of the opened hollow 73*d*. Thereby, the PTC thermistor 6 housed in the opened hollow 73*d* is supported on the support section 23 in a conductive state such that the PTC thermistor 6 makes electrically good contact with the support section 23.

In this embodiment, the internal wall 74 constitutes the bottom wall of the holding recess 73 excepting the opened hollow 73*d* which bottom wall includes that of the opened hollow 73*c* as shown in FIG. 4(*a*).

In this embodiment, a tip end portion 25 of the fixed-contact piece 2 is embedded between the internal wall 74 and the external wall 75, wherein the tip end portion 25 is defined as extending toward the terminal piece 3 from the end (on the terminal piece 3 side) of the opened hollow 73*d*.

The external wall 75 forms the under surface of the package 7. The external wall 75 is formed so as to cover almost the entire under surface of the fixed-contact piece 2.

As a result, the rigidity and strength of the package's main body 71 is increased, and the fixed-contact piece 2 and the package 7 are prevented from being deformed even in the warped state of the thermal actuator element 5 shown in FIG. 6.

As shown in FIG. 5(*a*) and FIG. 5(*b*), the external wall 75 is provided with a through-hole 76 penetrating therethrough. Preferably, a plurality of through-holes 76 (in this embodiment, three through-holes 76), are provided.

Each through-hole 76 is smaller than the opened hollow 73*d*, and arranged so that at least part of the through-hole 76 overlaps with at least part of the opened hollow 73*d* in a plan view, top plan view or bottom plan view, of the circuit breaker 1.

As to the shape of the through-hole 76, a circle is employed in this embodiment, but other shapes, e.g. ellipse, oval and the like may be employed.

By dispersing the through-holes 76 smaller than the opened hollow 73*d*, the rigidity and strength of the package's main body 71 can be maintained.

In this embodiment, each through-hole 76 is disposed within the opened hollow 73*d*, namely, each through-the hole 76 is overlapped in its entirety with a part of the opened hollow 73*d*.

Such main body 71 can be formed by, for example, inserting the fixed-contact piece 2 in a mold, injecting the resinous material into the cavity of the mold while supporting the fixed-contact piece 2 in the cavity, and hardening the injected resinous material.

FIGS. 7(*a*)-7(*d*) show processes for forming the package's main body 71.

In this embodiment, the main body 71 is molded by the use of a mold 200, for example, comprising a male die 210 and a female die 220.

The male die 210 is provided with a protrusion 211 for forming the opened hollow 73*d* in the package's main body 71. Further, the male die 210 is provided with protrusions 212 and 213 for forming the opened hollows 73*a* and 73*b* in the package's main body 71.

The female die 220 is provided with a protrusion 221 for forming the through-hole 76 in the package's main body 71. Further, the female die 220 is provided with protrusions 222 and 223 for supporting the fixed-contact piece 2 and the terminal piece 3 in the cavity of the mold.

In the cavity of the closed mold 200, the protrusion 221 of the female die 220 is opposed to the protrusion 211 of the male die 210 so that the protrusion 221 is overlapped with at least part of the protrusion 211 in a view corresponding to the plan view of the circuit breaker 1.

Thereby, the through-hole 76 overlapping with at least part of the opened hollow 73*d* in the plan view of the circuit breaker 1, is formed in the package's main body 71.

Further, in the cavity of the mold 200, the protrusion 222 of the female die 220 is opposed to the protrusion 212 of the male die 210 so that the protrusion 222 is overlapped with at least part of the protrusion 212 in a view corresponding to the plan view of the circuit breaker 1.

Furthermore, in the cavity of the mold 200, the protrusion 223 of the female die 220 is opposed to the protrusion 213 of the male die 210 so that the protrusion 223 is overlapped with at least part of the protrusion 213 in a view corresponding to the plan view of the circuit breaker 1.

The female die 220 in this embodiment has a runner 224 for feeding the resinous material to the mold cavity, and a gate 225 at the outer end of the runner 224.

In this embodiment, as shown in FIG. 7(*a*), the fixed-contact piece 2 and the terminal piece 3 are set on the female die 220 so that the protrusions 221 and 222 support the fixed-contact piece 2, and the protrusion 223 supports the terminal piece 3.

Then, the male die 210 and the female die 220 are fitted together, and the mold 200 is closed as shown in FIG. 7(*b*). Thereby, the mold cavity 230 is formed by the male die 210 and the female die 220.

In the closed state of the mold 200, since the protrusion 221 of the female die 220 is overlapped with at least part of the protrusion 211 of the male die 210, the fixed-contact piece 2 can be firmly supported from its both sides by the protrusion 211 and the protrusion 221.

In this embodiment, as explained above, three through-holes 76 are provided, therefore, three protrusions 221 are provided on the female die 220.

Since a plurality of through-holes 76 are provided on the package's main body 71, the female die 220 is provided with a plurality of protrusions 221.

Thereby, it is possible to more firmly and stably support the fixed-contact piece 2.

In the closed state of the mold 200, the fixed-contact piece 2 is firmly supported from the both sides by the protrusion 212 and the protrusion 222. Further, the terminal piece 3 is firmly supported from the both sides by the protrusion 213 and the protrusion 223.

Then, as shown in FIG. 7(*c*), the resinous material 71*b* for the package's main body 71 is injected through the gate 225 of the female die 220 so that the mold cavity 230 is filled with the resinous material 71*b*.

In this embodiment, the gate 225 is formed at a position to face the under surface of the joint section 33 of the terminal piece 3. It is of course possible to form the gate on the male die 210 instead of the female die 220.

As explained above, in the insert moulding method as shown in FIG. 7(*c*), there is a possibility that, by the pressure of the injected resinous material 71*b*, the fixed-contact piece 2 and the terminal piece 3 are deformed.

However, according to this embodiment, the deformation of the fixed-contact piece 2 can be prevented since the fixed-contact piece 2 is firmly supported from both sides by the protrusions 211 and 221 and the protrusions 212 and 222 as described above. Thereby, the fixed-contact piece 2 can keep its proper shape. Accordingly, by the support section 23 of the fixed-contact piece 2, the PTC thermistor 6 can be supported its proper position or posture. Thus, the position or posture of the thermal actuator element 5 when thermally transformed becomes proper. So the pushing-up height for the movable-contact piece 4, namely, the distance of the movable contact 41 from the fixed contact 21 in the opened state is properly maintained, and the circuit breaker 1 can provide a reliable current cutoff function.

Since the terminal piece 3 is firmly supported from both sides by the protrusion 213 and the protrusion 223, the deformation of the terminal piece 3 can be prevented, and the position or posture of the movable-contact piece 4 are kept properly. Therefore, the contact resistance between the fixed contact 21 and the movable contact 41 in the normal operating state can be properly maintained.

After the resinous material filled in the cavity 230 is hardened, as shown in FIG. 7(*d*), the mold 200 is opened, and the package's main body 71 is removed therefrom.

In the external wall 75 of the package's main body 71, the through-holes 76, 77 and 78 are formed by the protrusions 221, 222 and 223, respectively. The through-hole 77 is positioned on the under side of a part of the fixed contact 21 where the fixed-contact piece 2 is formed. The through-hole 78 is positioned on the under side of a part of the terminal piece 3 where the joint section 33 is formed.

In the internal wall 74 of the package's main body 71, the opened hollows 73*a*, 73*b*, 73*c* and 73*d* are formed by the protrusions 211, 212 and 213.

It is preferable that, as shown in FIG. 5, the through-hole 76 is positioned off the centroid O of the opened hollow 73*d*, in this example, positioned near the peripheral edge of the opened hollow 73*d*. Thereby, during molding the package's main body 71, the fixed-contact piece 2 can be firmly supported by the protrusion 211 and the protrusion 221 near the peripheral edge of the opened hollow 73*d*.

As a result, the resinous material is prevented from flowing over the fixed-contact piece 2 into the opened hollow 73*d* from the peripheral edge thereof, and the fixed-contact piece 2 can be further prevented from being deformed.

Preferably, the through-hole 76 is positioned on the tip end portion 25 side (cf. FIG. 6) of the centroid O of the opened hollow 73*d*.

As a result, during molding the package's main body 71, the tip end portion 25 of the fixed-contact piece 2 can be firmly supported between the protrusion 211 and the protrusion 221. Thereby, the tip end portion 25 can be further prevented from being deformed.

In the example shown in FIG. 5, therefore, two through-holes 76*a* and 76*b* are positioned on the tip end portion 25 side of the centroid O.

It is also preferable that the through-hole 76 is positioned on the gate 225 side or gate mark 79 side of the centroid O of the opened hollow 73*d*.

In the example shown in FIG. 5, therefore, the through-hole 76*a* is positioned on the gate mark 79 side of the centroid O.

As a result, the protrusion of the female die 220 for forming the concerned through-hole 76 comes close to the gate 225. Therefore, in the closed state of the mold shown in FIG. 7(*b*), the fixed-contact piece 2 can be firmly supported near the gate 225 by the protrusion 211 and the protrusion 221, and the fixed-contact piece 2 can be effectively prevented from being deformed by the pressure of the resinous material injected in the cavity 230 from the gate 225 during molding the package's main body 71.

During demolding the package's main body 71, the resin hardened in the gate 225 of the male die 210 breaks, and a vestige thereof is formed as gate mark 79 on the external wall 75 of the package's main body 71. (cf. FIG. 4 (*b*) and FIG. 5 (*b*))

In this embodiment, as shown in FIG. 4(*b*) and FIG. 5(*b*), the external wall 75 is provided in the under surface with a dent portion 79*a* so as to surround the gate mark 79.

The depth of the dent portion 79*a* from the under surface of the external wall 75 is set such that the gate mark 79 does not protrude from the under surface of the external wall 75. The shape and size of the dent portion 79*a* can be arbitrarily determined according to the shape and size of the gate 225.

As explained above, in the circuit breaker 1 of this embodiment, since the fixed-contact piece 2 is embedded between the internal wall 74 and the external wall 75 of the package's main body 71, the airtightness and the joint strength between the fixed-contact piece 2 and the package's main body 71 are improved.

Further, since the internal wall 74 of the package's main body 71 has the opened hollow 73*d* penetrating therethrough, the PTC thermistor 6 is housed in the opened hollow 73*d* in a conductive state capable of conducting electricity between the PTC thermistor 106 and the fixed-contact piece 102.

On the other hand, the external wall 75 of the package's main body 71 has the through-hole 76 penetrating therethrough.

Such package's main body 71 can be formed, for example, by inserting the fixed-contact piece 2 in the mold 200, and injecting the resinous material 71*b* in the mold 200. Since the through-hole 76 overlaps with at least part of the opened hollow 73*d* in the plan view, the cavity 230 of the mold 200 used in the injection moulding is provided with the protrusion 211 for forming the opened hollow 73*d* and the protrusion 221 for forming the through-hole 76 which are at least partially opposed to each other.

Such mutually opposed protrusions 211 and 221 can support the fixed-contact piece 2 from both sides thereof to prevent the fixed-contact piece 2 from being deformed by the injected resinous material.

Accordingly, the PTC thermistor 6, the thermal actuator element 5 and the like can be kept in their proper designed positions or postures, and the circuit breaker 1 can provide a reliable current cutoff function.

Since the through-hole 76 is positioned off the centroid o of the opened hollow 73*d*, the fixed-contact piece 2 can be firmly supported by the protrusions 211 and 221 near the peripheral edge of the opened hollow 73*d*.

Thereby, the resinous material of the package's main body 71 is prevented from flowing over the fixed-contact piece 2 into the opened hollow 73*d* from the peripheral edge thereof, and the fixed-contact piece 2 can be further prevented from being deformed.

While description has been made of the circuit breaker 1 as an embodiment of the present invention, various modifications are possible as follows.

After the package 7 is assembled, the circuit breaker 1 can be hermetically-sealed with resin or the like, for example by inserting the package 7 in a mold and injecting the resin or the like, so that the terminal 22 of the fixed-contact piece 2 and the terminal 32 of the terminal piece 3 are exposed outside the resultant hermetic seal coating.

The method for joining the cover 81 and the package's main body 71 is not limited to the ultrasonic welding. As far as they are firmly joined, another method, for example, a liquid or gelled adhesive agent can be employed.

The package 7 may have a structure made up of three or more parts aside from the structure made up of two parts, the package's main body 71 and the cover 81.

Instead of using two separate pieces: the movable-contact piece 4 and the thermal actuator element 5, it may be possible to use a single piece in which the movable-contact piece 4 and the thermal actuator element 5 are integrated by forming the movable-contact piece 4 from a laminate of thin metal plates such as bimetal and trimetal in order to simplify the structure of the circuit breaker and thereby further miniaturize the circuit breaker.

Further, the shapes of the fixed-contact piece 2, the terminal piece 3, the movable-contact piece 4, the thermal actuator element 5, the PTC thermistor 6, the holding recess 73 and the like can be changed arbitrarily without limited to those shown in the drawings.

Instead of using two separate pieces: the movable-contact piece 4 and the terminal piece 3, it may be possible to use a single piece in which the movable-contact piece 4 and the terminal piece 3 are integrated. In this case, such single piece is sandwiched between the package's main body 71 and the cover 81 which are welded to each other and thereby welded to the single piece.

The circuit breaker 1 of the present invention can be widely applied to a secondary battery pack, a safety circuit for electric devices and the like.

Figure 8:
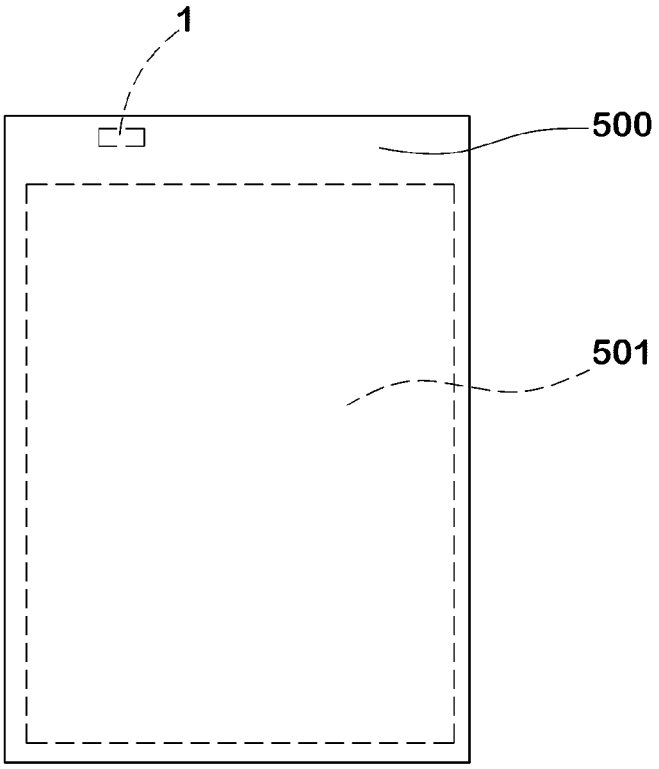
FIG. 8 is a plan view of a secondary battery pack including the circuit breaker according to the present invention.

FIG. 8 shows a secondary battery pack 500 which comprises a secondary battery 501 and the circuit breaker 1 inserted in an output circuit of the secondary battery 501.

Figure 9:
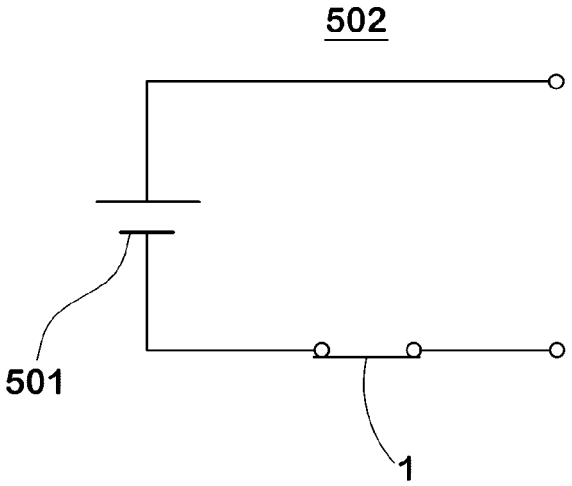
FIG. 9 is a circuit diagram of a safety circuit including the circuit breaker according to the present invention.
Figure 10:
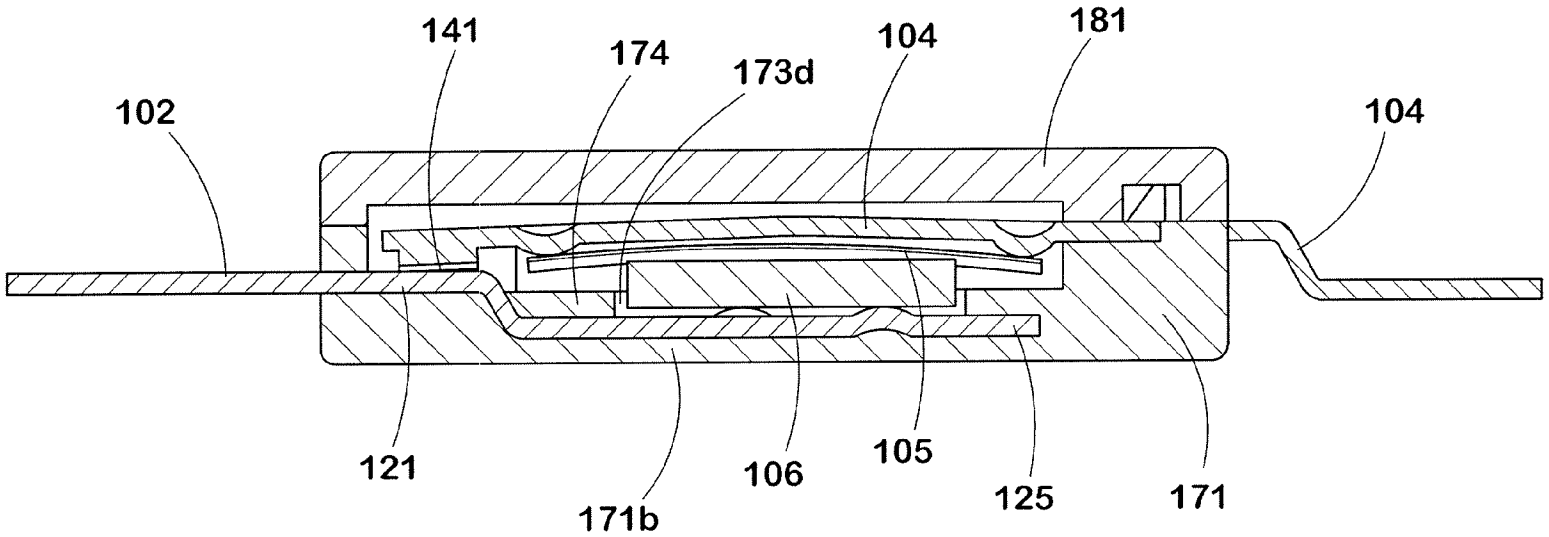
Prior Art FIG.10
FIG. 10 is a cross sectional view showing a conventional circuit breaker.
Figure 11:
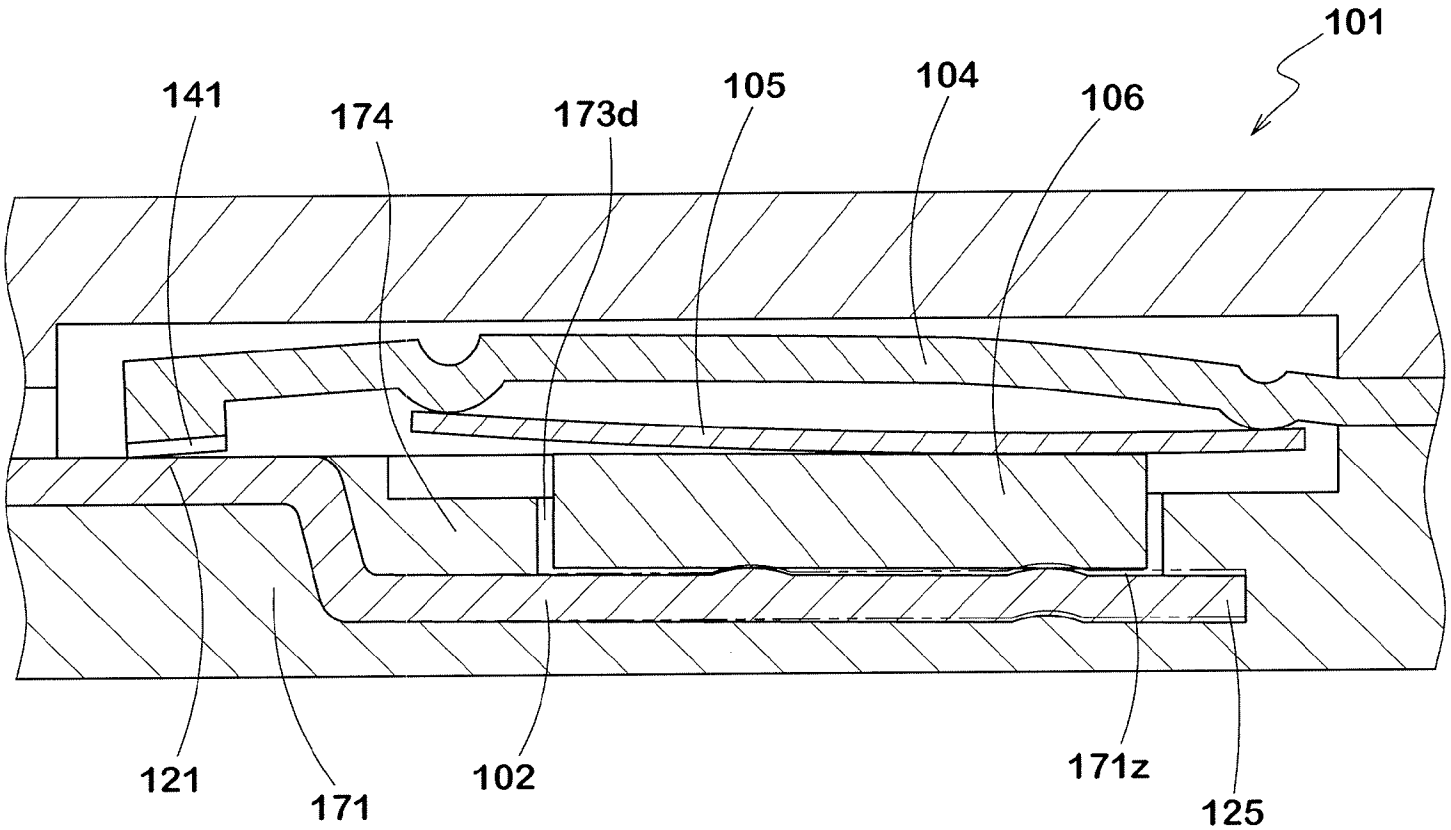
Prior Art FIG.11
FIG. 11 is a cross sectional view showing a state of the conventional circuit breaker in which the thermal actuator element is transformed by overheating.

FIG. 9 shows a safety circuit 502 for electric devices which comprises the circuit breaker 1 inserted in series in an output circuit of a secondary battery 501.

By incorporating the circuit breaker 1, it is possible to provide the secondary battery pack 500 or safety circuit 502 in which good current cutoff action is assured.

REFERENCE SIGNS LIST

1 circuit breaker
2 fixed-contact piece
21 fixed contact
25 tip end portion
3 terminal piece
4 movable-contact piece
41 movable contact
5 thermal actuator element
6 positive temperature coefficient (PTC) thermistor
7 package
71 package's main body
73 holding recess
73*d* opened hollow
74 internal wall
75 external wall
76 through-hole
81 cover
501 secondary battery
502 safety circuit

The invention claimed is:

1. A circuit breaker comprising:

a fixed-contact piece with a fixed contact, a movable-contact piece with a movable contact for pushing the movable contact onto the fixed contact to make contact therewith, a thermal actuator element transforming along with its temperature change to move the movable-contact piece so that the movable contact and the fixed contact are opened, a positive temperature coefficient (PTC) thermistor for conducting electricity between the movable-contact piece and the fixed-contact piece through the thermal actuator element when the movable contact and the fixed contact are opened, a main body of a package provided with a holding recess holding the fixed-contact piece, the movable-contact piece, the thermal actuator element and the PTC thermistor, and a cover hermetically covering the holding recess, wherein the fixed-contact piece is embedded between an internal wall and an external wall of the package's main body, the internal wall of the package's main body is provided with an opened hollow which penetrates through the internal wall and which houses the PTC thermistor in a conductive state capable of conducting electricity between the thermistor and the fixed-contact piece, the external wall of the package's main body is provided with a through-hole which penetrates through the external wall so that, in a plan view, at least part of the through-hole is overlapped with at least part of the opened hollow, and the through-hole is not overlapped with the centroid of the opened hollow.

2. The circuit breaker according to claim 1, wherein the fixed-contact piece has a tip end portion embedded in the package's main body between the internal wall and the external wall, and the through-hole is closer to the tip end portion than the centroid of the opened hollow in a longitudinal direction of the package's main body.

3. The circuit breaker according to claim 1, wherein the package's main body is formed by a resin injected through a gate of a die, and the through-hole is closer to the gate than the centroid of the opened hollow in a longitudinal direction of the package's main body.

4. The circuit breaker according to claim 2, wherein the package's main body is formed by a resin injected through a gate of a die, and the through-hole is closer to the gate than the centroid of the opened hollow in a longitudinal direction of the package's main body.

5. A safety circuit for an electric device comprising the circuit breaker according to claim 1.

6. A secondary battery circuit comprising the circuit breaker according to claim 1.

7. A safety circuit for an electric device comprising the circuit breaker according to claim 2.

8. A safety circuit for an electric device comprising the circuit breaker according to claim 3.

9. A safety circuit for an electric device comprising the circuit breaker according to claim 4.

10. A secondary battery circuit comprising the circuit breaker according to claim 2.

11. A secondary battery circuit comprising the circuit breaker according to claim 3.

12. A secondary battery circuit comprising the circuit breaker according to claim 4.

* * * * *